United States Patent [19]

Bradbury et al.

[11] Patent Number: 5,070,069

[45] Date of Patent: Dec. 3, 1991

[54] THERMAL TRANSFER PRINTING

[75] Inventors: Roy Bradbury, St. Helens; Peter A. Gemmell, Bentley; Richard A. Hann, Ipswich, all of England

[73] Assignee: Imperial Chemical Industries plc, London, England

[21] Appl. No.: 414,524

[22] Filed: Sep. 29, 1989

[30] Foreign Application Priority Data

Oct. 5, 1988 [GB] United Kingdom ..... 8823386

[51] Int. Cl.[5] ..... B41M 5/035; B41M 5/26

[52] U.S. Cl. ..... 503/227; 8/471; 428/195; 428/480; 428/913; 428/914

[58] Field of Search ..... 8/471; 428/195, 913, 428/914; 427/146; 503/227

[56] References Cited

U.S. PATENT DOCUMENTS 4,743,581 5/1988 Gregory ..... 503/227
4,857,503 8/1989 Jongewaard et al. ..... 503/227

FOREIGN PATENT DOCUMENTS 0209991 1/1987 European Pat. Off. ..... 503/227
0218397 3/1987 European Pat. Off. ..... 503/227

*Primary Examiner*—Bruce H. Hess
*Attorney, Agent, or Firm*—Cushman, Darby & Cushman

[57] ABSTRACT

A transfer sheet, suitable for use in a dye diffusion thermal transfer printing process for the production of images in accordance with a pattern information signal, comprising a substrate having a coating comprising a binder, one or more anthraquinone dyes of Formula I

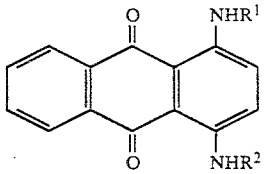

I wherein $R^1$ represents alkyl, alkenyl, cycloalkyl, haloalkyl, cyanoalkyl, alkoxyalkyl, alkoxyalkoxyalky, hydroxyalkyl, hydroxyalkoxyalkyl, hydroxyalkylthioalkyl, tetrahydrofurfuryl, alkenyloxyalkyl, tetrahydrofurfuryloxyalkyl, alkoxycarbonylalkyl, alkoxycarbonyloxyalkyl or alkoxycarbonyloxyalkyl, and $R^2$ represents any of the substituents represented by $R^1$ or a radical of the formula:

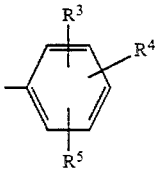

wherein $R^3$, $R^4$ and $R^5$ each independently represents hydrogen, halogen, and one or more bisazo dyes of Formula II:

A—N=N—B—N=N—E II wherein:

A is the residue of a diazotizable phenylamine or naphthylamine, A—$NH_2$, carrying not more than one unsaturated electron-withdrawing group;

B is an optionally substituted thiophen-2,5-ylene or thiazol-2,5-ylene group; and E is the residue of an aromatic coupling component E—X wherein X is an atom or group displaceable by a diazotized aromatic amine.

20 Claims, No Drawings

THERMAL TRANSFER PRINTING

INTRODUCTION

This invention relates to dye diffusion thermal printing (DDTTP), especially to a DDTTP sheet carrying a dye mixture, and to the use of the sheet in conjunction with a receiver sheet in a DDTTP process.

In DDTTP, a heat-transferable dye is applied to a sheet-like substrate in the form of an ink, usually containing a polymeric or resinous binder to bind the dye to the substrate, to form a transfer sheet. This is then placed in contact with the material to be printed, (generally a film of polymeric material such as a polyester sheet) hereinafter called the receiver sheet and selectively heated in accordance with a pattern information signal whereby dye from the selectively heated regions of the transfer sheet is transferred to the receiver sheet and forms a pattern thereon in accordance with the pattern of heat applied to the transfer sheet.

Important criteria in the selection of a dye for DDTTP are its thermal properties, brightness of shade, fastness properties, such as light fastness, and facility for application to the substrate in the preparation of the transfer sheet. For suitable performance the dye should transfer evenly, in proportion to the heat applied to the DDTTP sheet so that the depth of shade on the receiver sheet is proportional to the heat applied and a true grey scale of coloration can be achieved on the receiver sheet. Brightness of shade is important in order to achieve as wide a range of shades with the three primary dye shades of yellow, magenta and cyan. As the dye must be sufficiently mobile to migrate from the transfer sheet to the receiver sheet at the temperatures employed, 150–400° C., it is generally free from ionic and water-solubilising groups, and is thus not readily soluble in aqueous or water-miscible media, such as water and ethanol. Many suitable dyes are also not readily soluble in the solvents which are commonly used in, and thus acceptable to, the printing industry; for example, alcohols such as i-propanol, ketones such as methyl ethyl ketone (MEK), methyl i-butyl ketone (MIBK) and cyclohexanone, ethers such as tetrahydrofuran and aromatic hydrocarbons such as toluene. Although the dye can be applied as a dispersion in a suitable solvent, it has been found that brighter, glossier and smoother final prints can be achieved on the receiver sheet if the dye is applied to the substrate from a solution. In order to achieve the potential for a deep shade on the receiver sheet it is desirable that the dye should be readily soluble in the ink medium. It is also important that a dye which has been applied to a transfer sheet from a solution should be resistant to crystallisation so that it remains as an amorphous layer on the transfer sheet for a considerable time.

The following combination of properties is highly desirable for a dye which is to be used in DDTTP:

Ideal spectral characteristics (narrow absorption curve with absorption maximum matching a photographic filter)

High tinctorial strength.

Correct thermochemical properties (high thermal stability and good transferability with heat).

High optical densities on printing.

Good solubility in solvents acceptable to printing industry: this is desirable to produce solution coated dyesheets.

Stable dyesheets (resistant to dye migration or crystallisation).

Stable printed images on the receiver sheet (to heat, migration, crystallisation, grease, rubbing and light).

The achievement of good light fastness in DDTTP is extremely difficult because of the unfavourable environment of the dye, namely surface printed polyester on a white pigmented base. Many known dyes for polyester fibre with high light fastness (>6 on the International Scale of 1–8) on polyester fibre exhibit very poor light fastness (<3) in DDTTP.

It has been found that certain dyes which have already been proposed for use in DDTTP, especially disazo dyes which otherwise have outstanding performance in DDTTP, are susceptible to crystallisation, after transfer to the receiver sheet, particularly if they come into contact with solvents, such as organic waxes, greases or liquids. Crystallisation can affect the distribution of the dye on the receiver sheet and lead to a reduction in the optical density of the print. Thus, accidental spillages on, or even skin contact with, a DDTTP print containing such dyes, can cause a deterioration in print quality.

It has now been found that if such a disazo dye is mixed with an anthraquinone dye of similar shade the susceptibility to crystallisation is significantly reduced so that the mixture has excellent stability on the receiver sheet. Furthermore, the mixtures of anthraquinone dyes and disazo dyes provide prints having high light fastness and high optical density in addition to excellent stability.

THE INVENTION

According to a first aspect of the invention, there is provided a thermal transfer printing (DDTTP) sheet comprising a substrate having a coating comprising (1) an anthraquinone dye of Formula I:

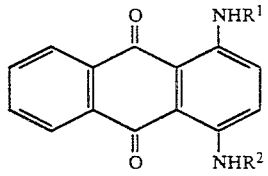

I wherein $R^1$ represents alkyl, alkenyl, cycloalkyl, haloalkyl, cyanoalkyl, alkoxyalkyl, alkoxyalkoxyalky, hydroxyalkyl, hydroxyalkoxyalkyl hydroxyalkylthioalkyl,, tetrahydrofurfuryl, alkenyloxyalkyl, tetrahydrofurfuryloxyalkyl, alkoxycarbonylalkyl, alkoxycarbonyloxyalkyl or alkoxycarbonyloxyalkyl, and $R^2$ represents any of the substituents represented by $R^1$ or a radical of Formula Ia:

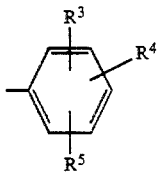

Ia wherein each of $R^3$, $R^4$ and $R^5$, independently, represents hydrogen, halogen, nitro, alkyl, alkenyl or alkoxy, and (2) a disazo dye of Formula II:

$$A—N=N—B—N=N—E \qquad II$$

wherein:

A is the residue of a diazotisable phenylamine or naphthylamine, $A—NH_2$, carrying not more than one unsaturated electron-withdrawing group;

B is an optionally substituted thiophen-2,5-ylene or thiazol-2,5-ylene group; and E is the residue of an aromatic coupling component E-X wherein X is an atom or group displaceable by a diazotised aromatic amine.

The Coating

The coating suitably comprises a layer of binder containing one or more dyes of Formula I and one or more dyes of Formula II. The ratio of binder to dye is preferably at least 1:1 and more preferably from 1.5:1 to 4:1 in order to provide good adhesion between the dye and the substrate and inhibit migration of the dye during storage. The dyes are preferably evenly distributed throughout the binder layer.

The coating may also contain other additives, such as curing agents, preservatives, etc., these and other ingredients being described more fully in EP 133011A, EP 133012A and EP 111004A.

The Binder

The binder may be any resinous or polymeric material suitable for binding the dye mixtures to the substrate which has acceptable solubility in the ink medium, i.e. the medium in which the dye and binder are applied to the transfer sheet. Examples of binders include cellulose derivatives, such as ethylhydroxyethylcellulose (EHEC), hydroxypropylcellulose (HPC), ethylcellulose, methyl- cellulose, cellulose acetate and cellulose acetate butyrate; carbohydrate derivatives, such as starch; alginic acid derivatives; alkyd resins; vinyl resins and derivatives, such as polyvinyl alcohol, polyvinyl acetate, polyvinyl butyral and polyvinyl pyrrolidone; polymers and co-polymers derived from acrylates and acrylate derivatives, such as polyacrylic acid, polymethyl methacrylate and styrene-acrylate copolymers, polyester resins, polyamide resins, such as melamines; polyurea and polyurethane resins; organosilicones, such as polysiloxanes, epoxy resins and natural resins, such as gum tragacanth and gum arabic. Mixtures of two or more of the above resins may also be used.

It is however preferred to use a binder which is soluble in one of the above-mentioned commercially acceptable organic solvents. Preferred binders of this type are EHEC, particularly the low and extra-low viscosity grades, and ethyl cellulose.

Anthraquinone dyes

In the anthraquinone dyes of Formula I, preferred alkyl radicals represented by $R^1$, $R^2$, $R^3$, $R^4$ or $R^5$ are $C_{1-20}$-alkyl, and more especially $C_{1-6}$-alkyl. Alkenyl radicals which may be so represented are preferably $C_{3-6}$-alkenyl and more especially $C_{3-4}$-alkenyl. Cycloalkyl radicals represented by $R^1$ and $R^2$ are preferably $C_{4-8}$ radicals, especially cyclohexyl. Alkoxy radicals represented by $R^3$, $R^4$ and $R^5$ are preferably $C_{1-20}$-alkoxy, especially $C_{1-6}$-alkoxy. Alkoxy and alkyl radicals present in more complex groups, for example, alkoxyalkyl or alkoxycarbonyloxyalkyl, are preferably $C_{1-4}$-alkyl and $C_{1-4}$-alkoxy. Halogen substituents represented by $R^3$, $R^4$ and $R^5$ or present in haloalkyl radicals are preferably chlorine or bromine.

It is preferred that $R^1$ is selected from $C_{1-6}$-alkyl, either branched or straight chain, $C_{1-4}$-alkoxy-$C_{1-4}$-alkyl, halo-$C_{1-4}$-alkyl, $C_{1-4}$-alkoxy-$C_{1-4}$-alkoxy-$C_{1-4}$-alkyl and cyclohexyl and $R^2$ is selected from phenyl; phenyl substituted by one or two groups selected from $C_{1-4}$-alkyl and $C_{1-4}$-alkoxy; $C_{1-4}$-alkoxy-$C_{1-4}$-alkyl; halo-$C_{1-4}$-alkyl, $C_{1-4}$-alkoxy-$C_{1-4}$-alkoxy-$C_{1-4}$-alkyl and cyclohexyl.

Disazo dyes

In the disazo dyes of Formula II, the residue, A, of the amine, $A—NH_2$, is preferably a phenyl group which may be unsubstituted or substituted by nonionic groups, preferably those which are free from acidic hydrogen atoms unless these are positioned so that they form intramolecular hydrogen bonds. By the term unsaturated electron-withdrawing group is meant a group of at least two atoms containing at least one multiple (double or triple) bond and in which at least one of the atoms is more electronegative than carbon. Examples of preferred unsaturated electron-withdrawing groups are —CN; —SCN; $—NO_2$; $—CONT_2$; $—SO_2NT_2$; —COT; $—SO_2T^1$; $—COOT^2$; $—SO_2OT^2$; —COF; —COCl; $—SO_2F$ and $—SO_2Cl$, wherein each T is independently H, $C_{1-4}$-alkyl or phenyl, $T^1$ is $C_{1-4}$-alkyl or phenyl and $T^2$ is $C_{1-4}$-alkyl.

Examples of other suitable substituents which may be carried by A in place of, or in addition to, the unsaturated electron-withdrawing group are $C_{1-4}$-alkyl, $C_{1-4}$-alkoxy, $C_{1-4}$-alkoxy- $C_{1-4}$-alkyl; $C_{1-4}$-alkoxy-$C_{1-4}$-alkoxy; $—NT_2$; halogen, especially Cl, Br and F; $CF_3$; cyano-$C_{1-4}$-alkyl and $C_{1-4}$-alkylthio.

It is preferred that A is of the formula:

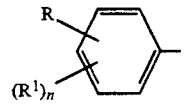

III wherein

R is selected from H, CN, SCN, $NO_2$, $—CONT_2—$, $—SO_2NT_2$, —COT, $—SO_2T^1$, $—COOT^2$, $—SO_2OT^2$, COF, —COCl, $—SO_2F$, $—SO_2Cl$; each $R^1$ is independently selected from H; $C_{1-4}$-alkyl; $C_{1-4}$-alkoxy; F; Cl; Br; $CF_3$ and $—NT_2$; and n is 1, 2 or 3.

Examples of phenyl and naphthyl groups represented by A are phenyl, 2-chlorophenyl, 4-chlorophenyl, 2,4-dichlorophenyl, 2-trifluoromethyl-4-chlorophenyl, 3,4-dichlorophenyl, 2-bromophenyl, 2-nitrophenyl, 4-nitrophenyl, 2-cyanophenyl, 3-cyanophenyl, 4-cyanophenyl, 2-trifluoromethylphenyl, 4-(methoxycarbonyl)phenyl, 4-(ethoxycarbonyl)phenyl, 4-methylphenyl, 3-methylphenyl, 4-(methylsulphonyl)phenyl, 4-thiocyanophenyl, 2-chloro-4-nitrophenyl and 1-naphthyl.

The optionally substituted thiophen-2,5-ylene or thiazol-2,5-ylene group, B, is preferably derived from a 2-aminothiophene or 2-aminothiazole having a hydrogen atom or a group displaceable by a diazotised amine in the 5-position and optionally other non-ionic substituents present in the 3- and/or 4- positions. Examples of suitable substituents for the 3- and 4- positions are those given above for A. Especially preferred substituents for the 4-position are $C_{1-4}$-alkyl; $C_{1-4}$-alkoxy; aryl, especially phenyl and $NO_2$-phenyl; $C_{1-4}$-alkoxy-CO; $C_{1-}$ 4alkoxy-$C_{1-4}$-alkoxy-CO— and halogen. Especially preferred substituents for the 3-position of the thiophen-2,5-ylene group are CN; $NO_2$; —$CONT_2$; —$SO_2NT_2$; —$COT^1$ and —$SO_2T^1$ and those given above for the 4-position.

It is preferred that B is a group of the formula:

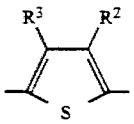

IV wherein $R^2$ is selected from CN, —$COOT^1$, —$COT^1$ and —$CONT_2$; and $R^3$ is H or $C_{1-4}$-alkyl.

It is especially preferred that $R^2$ is —CN; acetyl; methoxycarbonyl; ethoxycarbonyl or dimethylaminocarbonyl and $R^3$ is H or methyl.

Examples of suitable 2-aminothiophenes and 2-aminothiazoles are:

| | |
|---|---|
| 2-amino-3-cyanothiophene, | 2-amino-3-cyano-4-methylthiophene |
| 2-amino-3-acetylthiophene, | 2-amino-3-(ethoxycarbonyl)thiophene |
| 2-aminothiazole, | 2-amino-3-(aminocarbonyl)thiophene |
| 2-amino-4-methylthiazole, | 2-amino-3-(dimethylaminocarbonyl)-thiophene |

The coupling component is preferably of the formula, E—H, in which X is a displaceable hydrogen atom. It is further preferred that the coupling component is an optionally substituted aniline, naphthylamine, diaminopyridine, aminoheteroaromatic, such as tetrahydroquinoline and julolidine, or hydroxypyridone. Especially preferred coupling components are optionally substituted anilines and tetrahydroquinolines. Examples of suitable substituents for the rings of these systems are $C_{1-4}$-alkyl, $C_{1-4}$-alkoxy; $C_{1-4}$-alkyl- and phenyl-NH—CO—; $C_{1-4}$alkyl- and phenyl-CO—NH—; halogen, especially Cl and Br; $C_{1-4}$-alkyl-CO-O-$C_{1-4}$-alkyl; $C_{1-4}$-alkoxy-$C_{1-4}$-alkyl and cyano-$C_{1-4}$-alkyl. It is preferred that E is a 4-aminophenyl group preferably having one or two optionally substituted $C_{1-4}$-alkyl groups attached to the amino group and optionally carrying one ring substituent in the 3-position or two ring substituents in the 2 and 5 positions with respect to the amino group. Preferred ring substituents are $C_{1-4}$-alkyl, especially methyl; cyano-$C_{1-4}$-alkyl esp.2-cyanoethyl, $C_{1-4}$-alkoxy, especially methoxy or ethoxy and $C_{1-4}$-alkyl-CONH-, especially acetylamino. Preferred substituents for the amino group are independently selected from $C_{1-4}$-alkyl, especially ethyl and/or butyl; aryl, especially phenyl; $C_{4-8}$-cycloalkyl; and $C_{1-4}$-alkyl substituted by a group selected from OH; CN; halogen, especially F, Cl or Br; aryl, especially phenyl; $C_{1-4}$-alkoxy-$C_{1-4}$-alkoxy; $C_{1-4}$-alkoxy, $C_{1-4}$-alkyl-CO-, $C_{1-4}$-alkoxy-CO-, $C_{1-4}$-alkyl-COO-, $C_{1-4}$-alkoxy-O-$C_{1-4}$-alkoxy-CO-, $C_{1-4}$-alkoxy-COO-, $C_{1-4}$-alkyl-NHCOW wherein W is $C_{1-4}$-alkyl or optionlly substituted phenyl and $C_{1-4}$-alkylCONZ$^1$Z$^2$ wherein each of $Z^1$ and $Z^2$ independently, is H, $C_{1-4}$-alkyl or optionally substituted phenyl provided that at least one of $Z^1$ and $Z^2$ is not H.

It is especially preferred that E is a group of the formula:

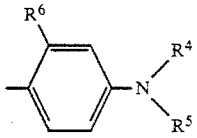

V wherein $R^4$ and $R^5$ are independently selected from H, $C_{1-4}$-alkyl, aryl, $C_{4-8}$-cycloalkyl and $C_{1-4}$-alkyl substituted by a group selected from OH, CN, halogen, aryl, $C_{1-4}$-alkoxy, $C_{1-4}$-alkoxy-$C_{1-4}$-alkoxy, $C_{1-4}$-alkyl-CO-, $C_{1-4}$-alkoxy-CO-, $C_{1-4}$-alkyl-COO-, $C_{1-4}$-alkoxy-$C_{1-4}$-alkoxy-CO-, $C_{1-4}$-alkoxy-COO-; and $R^6$ is selected from H, $C_{1-4}$-alkyl, cyano $C_{1-4}$-alkyl, $C_{1-4}$-alkoxy and —$NHCOT^1$.

The aryl group represented by, or contained in, $R^4$ and/or $R^5$ is preferably phenyl or substituted phenyl, examples of suitable substituents being those given above for A.

It is preferred that $R^4$ and $R^5$ are identical $C_{2-4}$-alkyl groups and especially that $R^4$ and $R^5$ are both ethyl or both n-propyl or both n-butyl. Where $R^4$ and $R^5$ are different it is preferred that $R^4$ is ethyl and $R^5$ is n-propyl or n-butyl. It is also preferred that $R^6$ is H, methyl or, more especially, acetylamino.

Examples of coupling components represented by E—H are: N,N-diethylaniline, N-n-butyl-N-ethylaniline, 3-methoxy-N,N-diethylaniline, 3-methyl-N-ethyl-N-benzylaniline, N,N-di(2-acetoxyethyl)aniline, 3-methyl-N,N-di(n-propyl)aniline, N,N-di(2-cyanoethyl-)aniline, 3-acetylamino-N,N-diethylaniline, N-ethyl-N-cyanoethylaniline, 3-B-Cyanoethyl-N,N-diethylaniline, 3-methyl-N,N-diethylaniline, 3-methyl-N-n-butyl-N-ethylaniline, 3-acetylamino-N,N-di(n-butyl)aniline, 3-methyl-N,N-di(2-acetoxyethyl)aniline, 3-acetylamino-N-ethyl-N-(n-butyl)aniline, 3-methoxy-N,N-di(2-[ethoxycarbonyl]ethyl)aniline, 3-methyl-N-n-butyl-N-2-(ethoxycarbonyl)ethylaniline, 3-methyl-N-n-butyl-N-[3-(ethoxycarbonyl)propyl]aniline.

A preferred sub-class of disazo dyes which may be used according to the present invention conform to Formula VI:

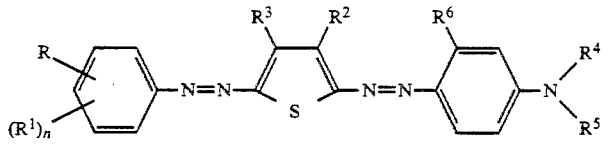

VI wherein

R is selected from H; —CN; —$NO_2$; —$CONT_2$—; —$SO_2NT_2$; —COT; —$SO_2T^1$; and $COOT^2$ and $SO_2OT^2$;

each $R^1$ is independently selected from H; halogen, especially F, Cl or Br; $CF_3$; $C_{1-4}$-alkyl; $C_{1-4}$-alkoxy; —$NT_2$;

n is 1, 2 or 3;

$R^2$ is selected from CN, —$COT^1$, —$CONT_2$ and $COOT^1$;

$R^3$ is H or $C_{1-4}$-alkyl;

$R^4$ and $R^5$ are independently selected from H, $C_{1-4}$-alkyl, phenyl, $C_{4-8}$-cycloalkyl and $C_{1-4}$-alkyl substituted by a group selected from OH, CN, $C_{1-4}$-alkoxy, $C_{1-4}$-alkoxy-$C_{1-4}$-alkoxy, $C_{1-4}$-alkyl-CO—, $C_{1-4}$-alkoxy-CO-, $C_{1-4}$-alkyl-COO—, halogen, $C_{1-4}$-alkoxy-$C_{1-4}$-alkoxy-CO-, $C_{1-4}$-alkoxy-COO- and phenyl; and $R^6$ is selected from H, $C_{1-4}$-alkyl, cyano $C_{1-4}$-alkyl, $C_{1-4}$-alkoxy and —$NHCOT^1$.

When there are two substituents selected from R and $R^1$ these are preferably in the 2 and 4 or 3 and 4 positions and where there are three substituents selected from R and $R^1$ these are preferably in the 2, 4 and 6 positions.

In an especially preferred class of dye within Formula VI, R is H, CN, $C_{1-4}$-alkyl-$SO_2$— or $C_{1-4}$-alkoxy-CO-; $R^1$ is H, Cl, Br, $CF_3$ or $C_{1-4}$-alkyl; $R^2$ is CN; $R^3$ is H or methyl; $R^6$ is $C_{1-4}$-alkyl-CONH—; and n=1.

Another preferred class of dye within Formula VI is that in which R and $R^3$ are H, n is 2 and each $R^1$ independently is H; halogen, especially F, Cl, or Br; $C_{1-4}$-alkyl; $C_{1-4}$-alkoxy or $CF_3$.

In each of the above preferred classes it is further preferred that $R^4$ and $R^5$ are identical and selected from $C_{1-4}$-alkyl A further preferred sub-class of disazo dyes which may be used in the thermal transfer printing sheet of the present invention conform to Formula VII:

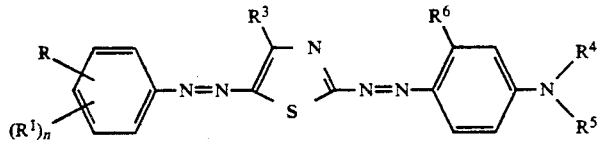

VII wherein

R is selected from H; —CN; —$NO_2$; —$CONT_2$—; —$SO_2NT_2$; —COT; —$SO_2T^1$; $COOT^2$ and $SO_2OT^2$;

$R^1$ is selected from H; halogen; $CF_3$; $C_{1-4}$-alkyl; $C_{1-4}$-alkoxy; —$NT_2$;

n is 1, 2 or 3;

$R^3$ is H or $C_{1-4}$-alkyl;

$R^4$ and $R^5$ are independently selected from H, $C_{1-4}$-alkyl, phenyl, $C_{4-8}$-cycloalkyl and 1–4substituted by a group selected from OH, CN, $C_{1-4}$-alkoxy, $C_{1-4}$-alkoxy-$C_{1-4}$-alkoxy, $C_{1-4}$alkyl-CO—, $C_{1-4}$-alkoxy-CO-, $C_{1-4}$-alkyl-COO-, halogen, $C_{1-4}$-alkoxy-$C_{1-4}$-alkoxy-CO-, $C_{1-4}$-alkoxy-COO- and phenyl; and $R^6$ is selected from H, $C_{1-4}$-alkyl, cyano $C_{1-4}$-alkyl, $C_{1-4}$-alkoxy and —$NHCOT^1$.

Preferred dyes of Formula VII are those in which R and $R^1$ are H; $R^3$ is H or methyl; $R^4$ and $R^5$ are ethyl, n-propyl or n-butyl, especially where $R^4$ and $R^5$ are identical; and $R^6$ is H, methyl or acetylamino.

A mixture dyes of Formula I and Formula II has particularly good thermal properties, giving rise to even prints on the receiver sheet, whose depth of shade is accurately proportional to the quantity of applied heat so that a true grey scale of coloration can be attained.

A mixture of dyes of Formula I and Formula II also has strong coloristic properties and good solubility in a wide range of solvents, especially those solvents which are widely used and accepted in the printing industry, for example, alkanols, such as i-propanol and butanol; aromatic hydrocarbons, such as toluene, and ketones such as MEK, MIBK and cyclohexanone. This produces inks (solvent, dye and binder) which are stable and allow production of solution coated dyesheets. The latter are stable, being resistant to dye crystallisation or migration during prolonged storage.

The combination of strong coloristic properties and good solubility in the preferred solvents allows the achievement of deep, even shades on the receiver sheet. The receiver sheets produced from the transfer sheets according to the present invention have bright, strong and even cyan shades which are fast to both light and heat.

The Substrate

The substrate may be any sheet material capable of withstanding the temperatures involved in DDTTP, up to 400° C. over a period of up to 20 milliseconds (msec) yet thin enough to transmit heat applied on one side through to the dyes on the other side to effect transfer to a receiver sheet within such short periods, typically from 1–10 msec. Examples of suitable materials are thin paper, especially high quality thin paper of having a smooth even surface, such as capacitor paper; heat resistant polymers, for example polyester, polyacrylate, polyamide, cellulosic and polyalkylene films; and metallised heat resistant polymers; including co-polymer and laminated films, especially laminates incorporating a polyester receptor layer on which the dyes are deposited. Such laminates preferably comprise, a backcoat, on the opposite side of the laminate from the receptor layer, of a heat resistant material, such as a thermosetting resin, e.g. a silicone, acrylate or polyurethane resin, to separate the heat source from the polyester and prevent melting of the latter during the DDTTP operation. The thickness of the substrate may be varied to some extent depending upon its thermal conductivity but it is preferably less than 20 micro-meters and more preferably less than 10 micrometers, especially from 2 to 6 micrometers.

Preparation of Transfer Sheet

The DDTTP sheet may be prepared by applying to a surface of the substrate (the receptor layer where this is present) a wet film of an ink comprising a solution or dispersion of the dye in a suitable solvent or solvent mixture, containing the binder or binders, and evaporating the solvent to produce the coating on the surface of the sheet.

The DDTTP Process

According to a further feature of the present invention there is provided a transfer printing process which comprises contacting a DDTTP sheet according to the first asp[ect of the invention with a receiver sheet, so that the coating is in contact with the receiver sheet and selectively heating areas of the transfer sheet whereby dye in the heated areas of the transfer sheet may be selectively transferred to the receiver sheet.

Heating in the selected areas may be effected by contact with heating elements, preferably heated to 250–400° C., more preferably above 300° C., over periods of 1 to 10 msec, whereby the dyes are heated to 150–300° C., depending on the time of exposure, and thereby caused to transfer, mainly by diffusion, from the transfer to the receiver sheet. Good contact between dye coating and receiver sheet at the point of application is essential to effect transfer. The depth of shade of the printed image on the receiver sheet will vary with the time period for which the transfer sheet is heated while in contact with that area of the receiver sheet.

The Receiver Sheet

The receiver sheet conveniently comprises a polyester sheet material, especially a white polyester film, preferably of polyethylene terephthalate (PET). Although some dyes of Formula I and Formula II are known for the coloration of textile materials made from PET, the coloration of textile materials, by dyeing or printing is carried out under such conditions of time and temperature that the dye can penetrate into the PET and become fixed therein. In thermal transfer printing, the time period is so short that penetration of the PET is much less effective and the substrate is preferably provided with a receptive layer, on the side to which the dye is applied, into which the dye more readily diffuses to form a stable image. Such a receptive layer, which may be applied by co-extrusion or solution coating techniques, may comprise a thin layer of a modified polyester or a different polymeric material which is more permeable to the dye than the PET substrate. While the nature of the receptive layer will affect to some extent the depth of shade and quality of the print obtained it has been found that the mixture of dyes of Formula I and Formula II gives particularly strong and good quality prints (e.9. fast to light, heat and storage) on any specific transfer or receiver sheet. The design of receiver and transfer sheets is discussed further in EP 133,011 and EP 133012.

Specific examples of suitable dyes of Formula I are shown in Table 1.

TABLE 1

| Dye | $R^1$ | $R^2$ |
|---|---|---|
| 1 | $-CH_3$ | 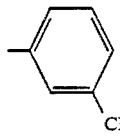 |
| 2 | $-CH_3$ | 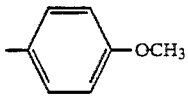 |
| 3 | $-(CH_2)_3CH_3$ | 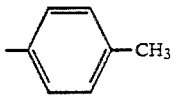 |
| 4 | $-CH_3$ | 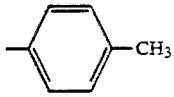 |
| 5 | $-CH_3$ | 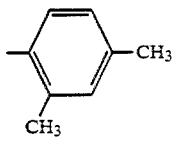 |

TABLE 1-continued

| Dye | $R^1$ | $R^2$ |
|---|---|---|
| 6 | $-CH_3$ | 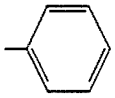 |
| 7 | $-CH_3$ | 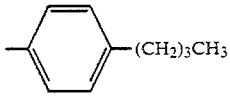 |
| 8 | $-CH(CH_3)_2$ | 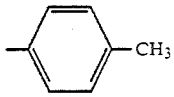 |
| 9 | $-CH(CH_3)_2$ | 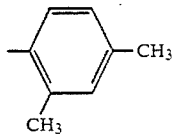 |
| 10 | $-CH(CH_3)_2$ | 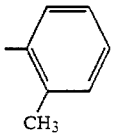 |
| 11 | $-CH(CH_3)_2$ | 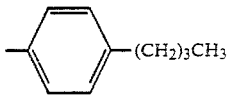 |
| 12 | $-C(CH_3)_3$ | 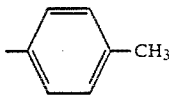 |
| 13 | $-H$ | 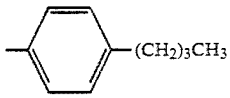 |
| 14 | $-H$ | 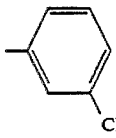 |
| 15 | $-CH(CH_3)CH_2CH_3$ | 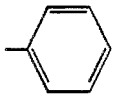 |
| 16 | $-(CH_2)_2O(CH_2)_2OCH_3$ | $-(CH_2)_2O(CH_2)_2OCH_3$ |
| 17 | $-(CH_2)_2OCOCH_3$ | $-(CH_2)_2OCOCH_3$ |
| 18 | $-CH(CH_3)_2$ | $-CH(CH_3)_2$ |
| 19 | $-(CH_2)_3OCH_3$ | $-(CH_2)_3OCH_3$ |

Specific examples of suitable dyes of Formula VI are shown in Table 2.

TABLE 2

| Dye | R | $R^1$ | $R^2$ | $R^3$ | $R^4$ | $R^5$ | $R^6$ |
|---|---|---|---|---|---|---|---|
| 20 | —H | —H | —CN | —H | $—C_2H_5$ | $—C_2H_5$ | $—NHCOCH_3$ |
| 21 | —H | —H | —CN | —H | $—(CH_2)_2OCH_2CH_3$ | $—C_2H_5$ | $—NHCOCH_3$ |
| 22 | —H | —H | —CN | —H | $—C_2H_5$ | $—C_2H_5$ | $—CH_3$ |
| 23 | —H | —H | —CN | —H | $—(CH_2)_3CH_3$ | $—C_2H_5$ | $—CH_3$ |
| 24 | —H | —H | —CN | —H | $—(CH_2)_3CH_3$ | $—CH(CH_3)C_2H_5$ | $—CH_3$ |
| 25 | —H | —H | —CN | —H | $—(CH_2)_3CH_3$ | $—C_2H_5$ | $—NHCOCH_3$ |
| 26 | 4-Cl | —H | —CN | —H | $—C_2H_5$ | $—C_2H_5$ | $—CH_3$ |
| 27 | 4-Cl | —H | —CN | —H | $—(CH_2)_3CH_3$ | $—C_2H_5$ | $—CH_3$ |
| 28 | 4-Cl | —H | —CN | —H | $—C_2H_5$ | $—C_2H_5$ | $—NHCOCH_3$ |
| 29 | 2-CN | —H | —CN | —H | $—C_2H_5$ | $—C_2H_5$ | $—NHCOCH_3$ |
| 30 | 3-CN | —H | —CN | —H | $—C_2H_5$ | $—C_2H_5$ | $—NHCOCH_3$ |
| 31 | 3-CN | —H | —CN | —H | $—(CH_2)_3CH_3$ | $—(CH_2)_3CH_3$ | $—NHCOCH_3$ |
| 32 | —H | —H | —CN | —H | $—(CH_2)_3CH_3$ | $—(CH_2)_3CH_3$ | $—NHCOCH_3$ |
| 33 | 4-CN | —H | —CN | —H | $—C_2H_5$ | $—C_2H_5$ | $—NHCOCH_3$ |
| 34 | $4-NO_2$ | —H | —CN | —H | $—C_2H_5$ | $—C_2H_5$ | $—NHCOCH_3$ |
| 35 | $2-NO_2$ | —H | —CN | —H | $—C_2H_5$ | $—C_2H_5$ | $—NHCOCH_3$ |
| 36 | $4-CH_3$ | —H | —CN | —H | $—C_2H_5$ | $—C_2H_5$ | $—NHCOCH_3$ |
| 37 | $2-CF_3$ | —H | —CN | —H | $—C_2H_5$ | $—C_2H_5$ | $—NHCOCH_3$ |
| 38 | $4-COCH_3$ | —H | —CN | —H | $—C_2H_5$ | $—C_2H_5$ | $—NHCOCH_3$ |
| 39 | $4-COOCH_3$ | —H | —CN | —H | $—C_2H_5$ | $—C_2H_5$ | $—NHCOCH_3$ |
| 40 | 2-Br | —H | —CN | —H | $—C_2H_5$ | $—C_2H_5$ | $—NHCOCH_3$ |
| 41 | 3-Cl | 4-Cl | —CN | —H | $—C_2H_5$ | $—C_2H_5$ | $—NHCOCH_3$ |
| 42 | $2-NO_2$ | $4-CH_3$ | —CN | —H | $—C_2H_5$ | $—C_2H_5$ | $—NHCOCH_3$ |
| 43 | 3-Cl | $4-CH_3$ | —CN | —H | $—C_2H_5$ | $—C_2H_5$ | $—NHCOCH_3$ |

The invention is further illustrated by the following examples in which all parts and percentages are by weight unless otherwise indicated.

Ink 1

This was prepared by dissolving 0.15 parts of Dye 1 in 5 parts of tetrahydrofuran (THF). 5 parts of a solution containing 6% of ethyl hydroxyethylcellulose, high viscosity (EHEC-H) were added and the mixture was stirred until homogeneous.

Inks 2–5

These were prepared by the same method as Ink 1 but using Dyes 2, 3, 20 and 21 respectively in place of Dye 1.

Ink 6

This was prepared by dissolving 0.075 parts of Dye 2 and 0.075 parts of Dye 20 in 5 parts of THF. 5 parts of a solution containing 6% of ethyl hydroxyethylcellulose-high viscosity (EHEC-H) were added and the mixture was stirred until homogeneous.

Ink 7

This was prepared by the same method as Ink 6 but using 0.1125 parts of Dye 2 and 0.0375 parts of Dye 20.

Ink 8

This was prepared by the same method as Ink 6 but using 0.0375 parts of Dye 2 and 0.1125 parts of Dye 20.

Ink 9

This was prepared by the same method as Ink 6 but using 0.075 parts of Dye 3 and 0.075 parts of Dye 20.

Ink 10

This was prepared by the same method as Ink 6 but using 0.1125 parts of Dye 3 and 0.0375 parts of Dye 20.

Ink 11

This was prepared by the same method as Ink 6 bur using 0.0375 parts of Dye 3 and 0.1125 parts of Dye 20.

Ink 12

This was prepared by the same method as Ink 6 but using 0.1125 parts of Dye 2 and 0.0375 parts of Dye 21.

Ink 13

This was prepared by the same method as Ink 6 but using 0.075 parts of Dye 1 and 0.075 parts of Dye 20.

Inks 14–29

A further 16 inks are prepared by the same method as Ink 6 using 0.075 parts of Dye 20 and 0.075 parts of each of Dyes 4 to 19.

Inks 30–47

A further 18 inks are prepared by the method of Ink 6 using 0.075 parts of Dye 21 and 0.075 parts of each of Dyes 1 and 3 to 19.

Inks 48–66

A further 19 inks are prepared by the same method as Ink 6 using 0.075 parts of Dye 22 and 0.075 parts of each of Dyes 1 to 19.

Inks 67–85

A further 19 inks are prepared by the method of Ink 6 using 0.075 parts of Dye 23 and 0.075 parts of each of Dyes 1 to 19.

Inks 86–104

A further 19 inks are prepared by the method of Ink 6 using 0.075 parts of Dye 24 and 0.075 parts of each of Dyes 1 to 19.

Inks 105–123

A further 19 inks are prepared by the same method as Ink 6 using 0.075 parts of Dye 25 and 0.075 parts of each of Dyes 1 to 19.

Inks 124–142

A further 19 inks are prepared by the method of Ink 6 using 0.075 parts of Dye 26 and 0.075 parts of each of Dyes 1 to 19.

Inks 143–16

A further 19 inks are prepared by the same method as Ink 6 using 0.075 parts of Dye 27 and 0.075 parts of each of Dyes 1 to 19.

Inks 162–180

A further 19 inks are prepared by the method of Ink 6 using 0.075 parts of Dye 28 and 0.075 parts of each of Dyes 1 to 19.

Inks 181–199

A further 19 inks are prepared by the method of Ink 6 using 0.075 parts of Dye 29 and 0.075 parts of each of Dyes 1 to 19.

Inks 200–218

A further 19 inks are prepared by the same method as Ink 6 using 0.075 parts of Dye 30 and 0.075 parts of each of Dyes 1 to 19.

Inks 219–237

A further 19 inks are prepared by the method of Ink 6 using 0.075 parts of Dye 31 and 0.075 parts of each of Dyes 1 to 19.

Inks 238–256

A further 19 inks are prepared by the method of Ink 6 using 0.075 parts of Dye 32 and 0.075 parts of each of Dyes 1 to 19.

Inks 257–271

A further 15 inks are prepared by the method of Ink 6 using 0.075 parts of Dye 33 and 0.075 parts of each of Dyes 1 to 15.

Inks 272–286

A further 15 inks are prepared by the method of Ink 6 using 0.075 parts of Dye 34 and 0.075 parts of each of Dyes 1 to 15.

Inks 287–301

A further 15 inks are prepared by the method of Ink 6 using 0.075 parts of Dye 35 and 0.075 parts of each of Dyes 1 to 15.

Inks 301–315

A further 15 inks are prepared by the method of Ink 6 using 0.075 parts of Dye 36 and 0.075 parts of each of Dyes 1 to 15.

Inks 316–330

A further 15 inks are prepared by the method of Ink 6 using 0.075 parts of Dye 37 and 0.075 parts of each of Dyes 1 to 15.

Inks 331–345

A further 15 inks are prepared by the method of Ink 6 using 0.075 parts of Dye 38 and 0.075 parts of each of Dyes 1 to 15.

Inks 346–360

A further 15 inks are prepared by the method of Ink 6 using 0.075 parts of Dye 39 and 0.075 parts of each of Dyes 1 to 15.

Inks 361–375

A further 15 inks are prepared by the method of Ink 6 using 0.075 parts of Dye 40 and 0.075 parts of each of Dyes 1 to 15.

Inks 376–390

A further 15 inks are prepared by the method of Ink 6 using 0.075 parts of Dye 41 and 0.075 parts of each of Dyes 1 to 15.

Inks 391–405

A further 15 inks are prepared by the method of Ink 6 using 0.075 parts of Dye 42 and 0.075 parts of each of Dyes 1 to 15.

Inks 406–420

A further 15 inks are prepared by the method of Ink 6 using 0.075 parts of Dye 43 and 0.075 parts of each of Dyes 1 to 15.

Transfer Sheet TS1

This was prepared by applying Ink 1 to a 6 micrometer thick polyethylene terephthalate sheet (substrate) using a wire-wound metal Meyer bar (K-bar No.3) to produce a wet film of ink on the surface of the sheet. The ink was dried with hot air to give a dry film on the surface of the substrate.

Transfer Sheets TS2 - TS13

These were prepared in the same manner as TS1 using each of Inks 2–13 in place of Ink 1.

Transfer Sheets TS14 - TS420

These are prepared by the same method as TS1 using each of Inks 14 to 405 in place of Ink 1

Printed Receiver Sheet RS1

A sample of TS1 was contacted with a receiver sheet, comprising a composite structure based in a white polyester base having a receptive coating layer on the side in contact with the printed surface of TS1. The receiver and transfer sheets were placed together on the drum of a transfer printing machine and passed over a matrix of closely-spaced pixels which were selectively heated in accordance with a pattern information signal to a temperature of >300° C. for periods from 2 to 10 msec, whereby a quantity of the dye, in proportion to the heating period, at the position on the transfer sheet in contact with a pixel while it was hot was transferred from the transfer sheet to the receiver sheet. After passage over the array of pixels the transfer sheet was separated from the receiver sheet.

Printed Receiver Sheets RS2 to RS13

These were prepared in the same way as RSI using TS2 to TS13 in place of TS1.

Printed Receiver Sheets RS14 to RS420

These are prepared in the same way as RSl using TS14 to TS405 in place of TS1.

Evaluation of Inks, Transfer Sheets and Printed Receiver Sheets

The stability of the ink and the quality of the print on transfer sheets TS1 to TS13 was assessed by visual inspection. An ink was considered stable if there was no precipitation over a period of two weeks at ambient and a transfer sheet was considered stable if it remained substantially free from crystallisation for a similar period.

The quality of the printed impression on receiver sheets RS1 to RS13 was assessed in respect of reflected optical density (OD), of colour measured with a Sakura digital densitometer. The grease resistance (GNT 2) of the print was assessed by measuring the reflected OD as above after rubbing with a pad soaked in lard oil for a set period and incubation at 55° C. and 60% relative humidity for 24 hours. The GNT 2 values are expressed as a % change in OD where the smaller the value the better is the performance of the dye or dye mixture.

The results of these evaluations are shown in Table 3.

TABLE 3

| Receiver sheet | GNT 2 (% change in OD) |
|---|---|
| 1 | 1.6 |
| 2 | 15.6 |
| 3 | 14.4 |
| 4 | 15.2 |
| 5 | 13.6 |
| 6 | 1.5 |
| 7 | 11.9 |
| 8 | 8.1 |
| 9 | 4.3 |
| 10 | 7.1 |
| 11 | 12.0 |
| 12 | 12.5 |
| 13 | 1.3 |

The quality of transfer sheet TS14 to TS420 and the printed impression on receiver sheets RS14 to RS420 is assessed in the same manner.

We claim:

1. A thermal transfer printing sheet comprising a substrate having a coating comprising a binder, one or more anthraquinone dyes of Formula I:

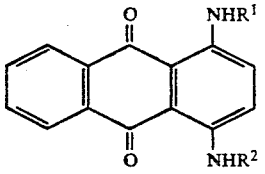

I wherein $R^1$ represents alkyl, alkenyl, cycloalkyl, haloalkyl, cyanoalkyl, alkoxyalkyl, alkoxyalkoxyalky, hydroxyalkyl, hydroxyalkoxyalkyl, hydroxyalkylthioalkyl, tetrahydrofurfuryl, alkenyloxyalkyl, tetrahydrofurfuryloxyalkyl, alkoxycarbonylalkyl, alkoxycarbonyloxyalkyl or alkoxycarbonyloxyalkyl, and $R^2$ represents any of the substituents represented by $R^1$ or a radical of the formula:

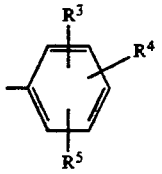

wherein each of $R^3$, $R^4$ and $R^5$, independently, represents hydrogen, halogen, nitro, alkyl, alkenyl or alkoxy, and one or more bisazo dyes of Formula II:

$$A—N=N—B—N=N—E \qquad II$$

wherein:

A is the residue of a diazotisable phenylamine or naphthylamine, $A—NH_2$, carrying not more than one unsaturated electron-withdrawing group;

B is an optionally substituted thiophen-2,5-ylene group; and

E is the residue of an aromatic coupling component E-X wherein X is an atom or group displaceable by a diazotised aromatic amine.

2. A thermal transfer printing sheet according to claim 1 wherein in the anthraquinone dye, $R^1$ is selected from $C_{1-6}$-alkyl, $C_{1-4}$-alkoxy-$C_{1-4}$-alkyl, $C_{1-4}$-alkoxy-$C_{1-4}$-alkoxy-$C_{1-4}$-alkyl, halo-$C_{1-4}$-alkyl, $C_{2-6}$-alkenyl and $C_{4-8}$-cycloalkyl.

3. A thermal transfer printing sheet according to claim 1 or claim 2 wherein in the anthraquinone dye, $R^2$ is of the formula:

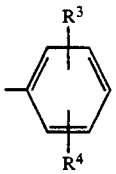

Ia in which $R^3$ and $R^4$ are selected from hydrogen, $C_{1-6}$-alkyl, $C_{3-6}$-alkenyl, $C_{4-8}$-cycloalkyl, $C_{1-6}$-alkoxy, $C_{1-4}$-alkoxy -$C_{1-4}$-alkyl, halo-$C_{1-4}$-alkyl, halogen and $C_{1-4}$-alkoxycarbonyloxy -$C_{1-4}$-alkyl.

4. A thermal transfer printing sheet according to claim 1 wherein $R^1$ is $C_{1-4}$-alkyl and $R^2$ is phenyl carrying one or two groups selected from $C_{1-4}$-alkyl and $C_{1-4}$-alkoxy.

5. A thermal transfer printing sheet according to claim 1 wherein $R^1$ and $R^2$ in the anthraquinone dye are selected from $C_{1-6}$-alkyl, $C_{1-6}$-alkoxy, $C_{1-4}$-alkoxy-$C_{1-4}$-alkyl, $C_{1-4}$-alkoxy-Chd 1-4-alkoxy -$C_{1-4}$-alkyl, $C_{1-4}$-alkoxycarbonyloxy-$C_{1-4}$-alkyl, chloro-$C_{1-4}$-alkyl and bromo-$C_{1-4}$-alkyl.

6. A thermal transfer printing sheet according to claim 1 wherein A in the disazo dye is of Formula III:

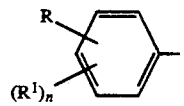

III wherein

R is selected from H, CN, SCN, $NO_2$, $—CONT_2—$, $—SO_2NT_2$, —COT, $—SO_2T^1$, $—COOT^2$, $—SO_2OT^2$, COF, —COCl, $—SO_2F$, $—SO_2Cl$;

T is independently H, $C_{1-4}$-alkyl or phenyl $T^1$ is $C_{1-4}$-alkyl or phenyl, and $T^2$ is $C_{1-4}$-alkyl;

each R' is independently selected from H; $C_{1-4}$-alkyl; $C_{1-4}$-alkoxy; F; Cl; Br; $CF_3$ and $—NT_2$; and n is 1, 2 or 3.

7. A thermal transfer printing sheet according to claim 1 wherein B in the disazo dye if of Formula IV:

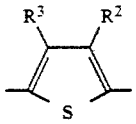

IV wherein $R^2$ is selected from CN, —$COOT^1$, —$COT^1$ and —$CONT_2$;

T is independently H, $C_{1-4}$-alkyl or phenyl, $T^1$ is $C_{1-4}$-alkyl or phenyl; and $R^3$ is H or $C_{1-4}$-alkyl.

8. A thermal transfer printing sheet according to claim 7 wherein in the disazo dye of Formula VI:

R is selected from —H, —CN, $C_{1-4}$-alkyl-$SO_2$— and $C_{1-4}$-alkoxy-CO—;

$R^1$ is selected from —H, —Cl, —Br, —$CF_3$ and $C_{1-4}$-alkyl;

$R^2$ is —CN;

$R^3$ is —H or —$CH_3$;

$R^6$ is H, $C_{1-4}$-alkyl-CONH— or —$CH_3$; and n is 1.

9. A thermal transfer printing sheet according to claim 1 wherein E in the disazo dye is of the Formula V:

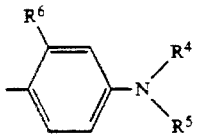

V wherein $R^4$ and $R^5$ are independently selected from H, $C_{1-4}$-alkyl, aryl, $C_{4-8}$-cycloalkyl and $C_{1-4}$-alkyl substituted by a group selected from OH, CN, halogen, aryl, $C_{1-4}$-alkoxy, $C_{1-4}$-alkoxy- $C_{1-4}$-alkoxy, $C_{1-4}$-alkyl-CO, $C_{1-4}$-alkoxy-CO—, $C_{1-4}$-alkyl-COO—, $C_{1-4}$-alkoxy-$C_{1-4}$-alkoxy-CO, $C_{1-4}$-alkoxy-COO;

$R^6$ is selected from H, $C_{1-4}$-alkyl, cyano $C_{1-4}$-alkyl, $C_{1-4}$-alkoxy and —$NHCOT^1$; and $T^1$ is $C_{1-4}$-alkyl or phenyl.

10. A thermal transfer printing sheet according to claim 1 wherein the disazo dye is of Formula VI:

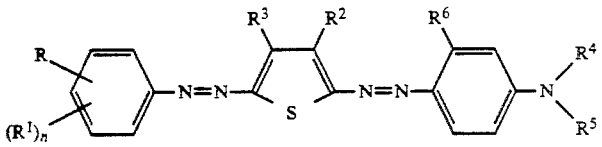

VI wherein

R is selected from H; —CN; —$NO_2$; —$CONT_2$—; —$SO_2NT_2$; —COT; —$SO_2T^1$ $COOT^2$ and $SO_{20}T^2$;

each $R^1$ is independently selected from H; halogen, especially F, Cl or Br; $CF_3$; $C_{1-4}$-alkyl; $C_{1-4}$-alkoxy; —$NT_2$;

n is 1, 2 or 3;

$R^2$ is selected from CN, —$COT^1$, —$CONT_2$ and $COOT^1$;

$R^3$ is H or $C_{1-4}$-alkyl;

$R^4$ and $R^5$ are independently selected from H, $C_{1-4}$-alkyl, phenyl, $C_{4-8}$-cycloalkyl and $C_{1-4}$-alkyl substituted by a group selected from OH, CN, $C_{1-4}$-alkoxy, $C_{1-4}$-alkoxy-$C_{1-4}$-alkoxy, $C_{1-4}$-alkyl-CO—, $C_{1-4}$-alkoxy-CO—, $C_{1-4}$-alkyl-COO—, halogen, $C_{1-4}$-alkoxy-$C_{1-4}$-alkoxy-CO—, $C_{1-4}$-alkoxy-COO— and phenyl; and $R^6$ is selected from H, $C_{1-4}$-alkyl, cyano $C_{1-4}$-alkyl, $C_{1-4}$-alkoxy and —$NHCOT^1$ wherein each T is independently —H, $C_{1-4}$-alkyl or phenyl, $T^1$ is $C_{1-4}$-alkyl or phenyl and $T^2$ is $C_{1-4}$-alkyl.

11. A thermal transfer printing sheet according to claim 1 wherein the mixture of dyes comprises an anthraquinone dye of Formula I:

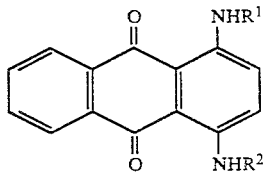

I wherein $R^1$ is methyl or n-butyl and $R^2$ is 3-methylphenyl, 4-methylphenyl or 4-methoxyphenyl and a bis azo dye of Formula VI

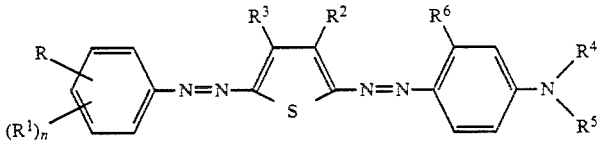

VI wherein R, $R^1$ and $R^3$ are hydrogen, $R^2$ is —CN, $R^4$ and $R^5$ are independently $C_{1-4}$-alkyl or $C_{1-4}$-alkoxy-$C_{1-}$-alkyl and $R^6$ is H, methyl or acetylamino.

12. A transfer printing process which comprises contacting a transfer sheet according to claim 1 with a receiver sheet, so that the mixture of dyes of Formulae I and II are in contact with the receiver sheet and selectively heating areas of the transfer sheet whereby the dyes in the heated areas of the transfer sheet may be transferred to the receiver sheet.

13. A transfer printing process according to claim 14 wherein the transfer sheet is heated to a temperature from 300° C. to 400° C. for a period of 1 to 20 milliseconds while in contact with the receiver sheet whereby the amounts of the mixtures of dyes of Formula I and II are which transferred is proportional to the heating period.

14. A transfer printing process according to claim 13 wherein the receiver sheet is white polyester film.

15. A transfer printing process according to claim 12 wherein the receiver sheet is white polyester film.

16. A process for the preparation of a thermal transfer printing sheet according to claim 1 which comprises applying an ink comprising 0.1 to 10% of the mixture of dyes of Formulae I and II and 0.1 to 10% of the binder in a solven to the substrate and evaporating the solvent to produce a coating of the dye mixture and binder on the substrate.

17. A thermal transfer printing sheet according to claim 1 wherein the substrate is <20 um in thickness and is capable of withstanding temperatures up to 400° C. for up to 20 milliseconds and is selected from paper, polyester, polyacrylate, polyamide, cellulosic and polyalkylene films, metallised forms thereof, including copolymer and laminated films and laminates incorporating polyester receptor layers.

18. A thermal transfer printing sheet according to claim 1 wherein the binder is any resinous or polymeric material suitable for binding the dye to the substrate.

19. A thermal transfer printing sheet according to claim 1 wherein the binder to dye ratio is from 1:1 to 4:1.

20. A thermal transfer printing sheet according to claim 1 wherein the binder is selected from ethyl hydroxycellulose, hydroxpropylcellulose, methylcellulose, ethylcellulose, cellulose acetate, cellulose acetate butyrate; starch; alginic acid derivatives; alkyd resins; polyvinylalcohol, polyvinyl butyral; polyvinyl pyrrolidone; polyacrylic acid, polymethylmethacrylate, styrene-acrylate co-polymers; polyester resins; polyamide resins; melamines; polyurea and polyurethane resins; polysiloxanes; epoxy resins; and gum tragacanth and gum arabic.

* * * * *